United States Patent [19]

Swisher, Jr.

[11] Patent Number: 4,919,538

[45] Date of Patent: Apr. 24, 1990

[54] DRUM MIXER HAVING A COMBINED MIXING AND HEATING ZONE

[76] Inventor: George W. Swisher, Jr., 1500 Dorchester Dr., Oklahoma City, Okla. 73120

[21] Appl. No.: 385,556

[22] Filed: Jul. 26, 1989

[51] Int. Cl.[5] ..... B28C 5/46

[52] U.S. Cl. ..... 366/4; 366/25; 366/56

[58] Field of Search ..... 366/2, 4, 15, 24, 25, 366/40, 54, 56, 7

[56] References Cited

U.S. PATENT DOCUMENTS

| | | | |
|---|---|---|---|
| 4,147,436 | 4/1979 | Garbelman et al. | 366/25 |
| 4,298,287 | 11/1981 | McCarter, III et al. | 366/25 X |
| 4,332,478 | 6/1982 | Binz | 366/25 X |
| 4,481,039 | 11/1984 | Mendenhall | 366/25 X |
| 4,813,784 | 3/1989 | Musil | 366/25 X |

*Primary Examiner*—Frankie L. Stinson

*Attorney, Agent, or Firm*—Dunlap, Codding, Peterson & Lee

[57] ABSTRACT

A combustion housing for surrounding a burner flame is provided at an intermediate location within a drum mixer. An annulus is formed by the combustion housing and the interior of the drum adjacent thereto. Hot virgin aggregate is mixed with cold recycle material within the annulus. The mixing materials are further heated by conduction from the combustion housing surface and extending structures extending from the combustion housing into the annulus. The combustion housing is also provided with a plurality of openings for allowing radiant heat to enter the annulus and heat the mixing materials and for circulating combustible by products of asphalt production into the combustion housing for burning.

34 Claims, 4 Drawing Sheets

DRUM MIXER HAVING A COMBINED MIXING AND HEATING ZONE

BRIEF SUMMARY OF THE INVENTION

1. Field of the Invention

The present invention relates generally to drum mixers used for producing an asphaltic composition.

2. Background of the Invention

In the present state of the art of making hot mix asphalt in a drum mixer type plant wherein a portion of the materials used in making the composition comprises recycle asphalt, there are basically two types of drums; a parallel-flow drum and a counter-flow drum.

A parallel-flow drum is represented by U.S. Pat. Nos. Re: 31,904 and 31,905. In such a parallel-flow drum, the burner is located at the higher, input end of the drrum where virgin aggregate is introduced, such that the virgin aggregate flow is parallel with the flow of the hot gases of combustion. Recycle material is introduced at a cooler zone of the drum and flows, along with the hot virgin aggregate, parallel to the flow of the got gases of combustion, such that the recycle material is heated both by contact with the hot virgin aggregate and the gases of combustion.

A counter-flow drum is represened by U.S. Pat. No. 4,787,938. In this type of drum, the burner is located at an intermediate point in the drum with the hot gases of combustion flowing toward the higher, innput end of the drum where the virgin aggregate is introduced. Thus, the virgin aggregate and hot gases of combustion are in counter-flowing relation. The recycle material is introduced into the drum downstream from the burner, with the hot virgin aggregate and the recycle material being mixed in the drum downstream from the burner. In this type of drum, the recycle material is heated solely, or almost solely, by contact with the hot virgin aggregate. A similar process is carried out in what is known in the art as a double barrel arrangement where the hot virgin aggregate is discharged from the lower end of a rotating drum outwardly into a housing surrounding a portion of the drum, and the recycle material is introduced into the housing around the rotating drum for mixture with the hot virgin aggregate. Here again, the recycle material is heated almost solely by the hot virgin aggregate.

In the present invention, the burner is located at an intermediate position in the drum to direct a flow of hot combustion gases toward the upper, input end of the drum where the virgin aggregate is introduced, such that the flow of combustion gases and virgin aggregate in this portion of the drum are countercurrent. A ringed combustion housing is secured within the drum and substantially encircles the flame. The interior of the ringed combustionn housing forms a combustion chamber. The inner surface of the drum and outer surface of the ringed combustion housing forms an annulus. The rings of the combustion housing are arranged in end-to-end fashion such that an opening is created between adjacent rings. In this way, a portion of the radiant heat produced within the combustion chamber enters the annulus.

Generally, heated virgin aggregate enters the annulus and is combined with recycle material. The materialsl within the annulus are heated by conduction from the combustion housing and by radiation through the openings between the rings. Additional heat transfer from the combustion housing to the materials within the annulus is accomplished by a plurality of projections secured to the combustion housing and extending into the annulus. In this way, the combustion housing rapidly transfers heat from the combustion chamber to the mixing materials while preventing the mixing materials from entering the combustion chamber.

As the mixing materials exit the annulus in route to the second end of the drum, liquid asphalt and mineral filler may be added in the usual manner. Combustible materials created or released within the drum between the second end and the combustion housing are drawn, through the openings in the combustion housing, into the combustion chamber and burned.

Thus, unlike the prior art systems which are equipped with a single heating zone, and as a result must utilize separate portions of the drum mixer for developing hot combustion gases, drying virgin aggregate, and mixing the heated virgin aggregate with recycle material, the combustion housing of the present invention creates two heating zones within the drum mixer. As a result, hot combustion gas development, aggregate drying, aggregate mixing and continued heating of the mixing aggregate are accomplished in a common section of the drum mixer. In this way, the overall length of the drum mixer can be reduced without sacrificing production capacity.

The present invention also increases the capacity for heat transfer therein from the hot combustion gases to the asphaltic materials. As a result, the drum mixer of the present invention can accommodate a broader range of burners than prior art systems. Burner selection flexibility provides the drum mixer of the present invention with a greater range in hot mix production capacity.

DESCRIPTION OF THE PREFERRED EMBODIMENTS

Figure 1:
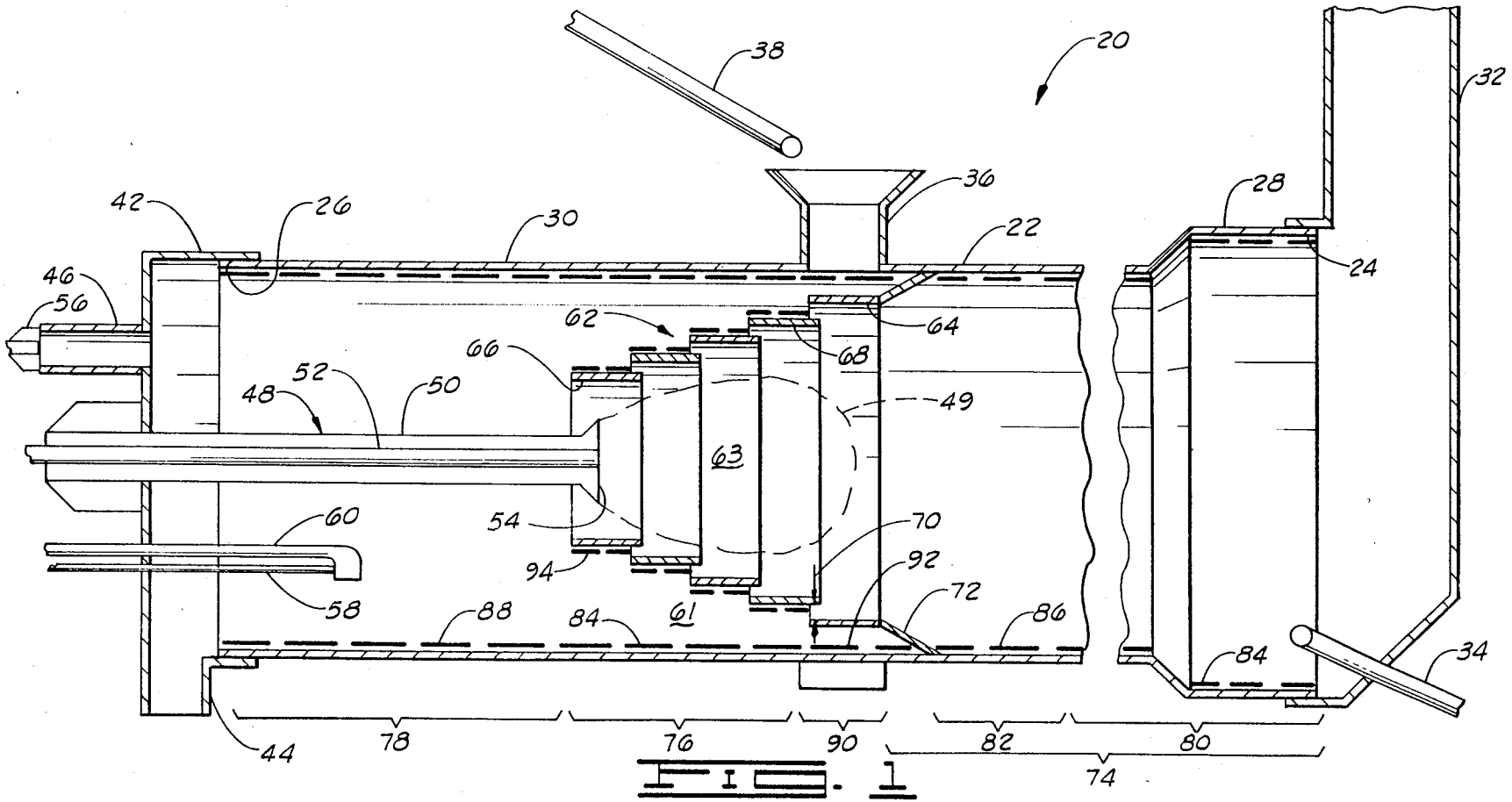
FIG. 1 is a semi-schematic vertical cross-sectional view of a drum mixer constructed in accordance with the present invention.

As shown in FIG. 1, the present invention comprises a drum mixer designated generally by the reference numeral 20. The drum mixer 20 includes a drum 22 having a first end 24 and a second end 26. It will be understood that the drum 22 is positioned in a slightly inclined position wherein the level of the first end 24 is above the level of the second end 26. It will be further understood that the drum 22 may be rotated in this position by a conventional drive system (not shown).

An expanded portion 28 extends from the first end 24 of the drum 22 and terminates in a small diameter portion 30. The smaller diameter portion 30 continues from the expanded portion 28 and terminates at the second end 26 of the drum 22.

Portions of the first end 24 extend into a conventional exhaust collection system 32 and freely rotate within the exhaust collection system. A conveyor 34 extends through portions of the exhaust collection system 32 and into the drum 22 at the first end 24 for introducing a first volume of material (virgin aggregate) therein. It will be understood that the first volume of material may also consist of virgin aggregate and recycle material.

Figure 4:
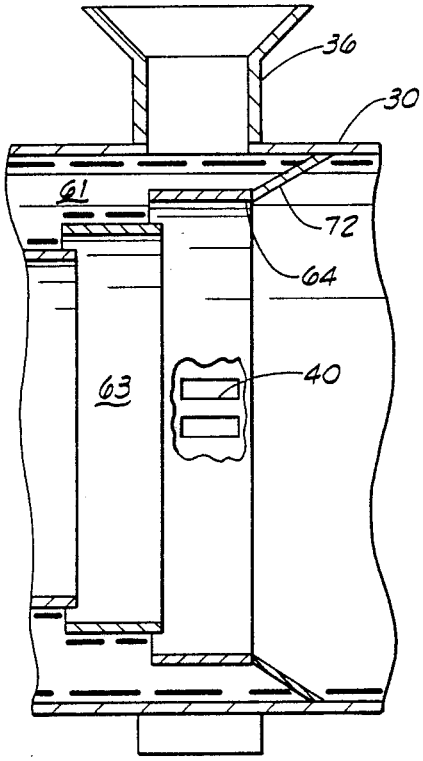
FIG. 4 is an enlarged fragmented view of a portion of the drum mixer illustrated in FIG. 1.

A material entry collar 36 is secured to the smaller diameter portion 30 between the expanded portion 28 and the second end 26 of the drum 22. A second volume of material (recycle material) is supplied to the collar 36 by a conveyor 38 and enters the drum 22 through a plurality of material ports 40 (FIG. 4). It is understood that the second volume of material may also consist of virgin aggregate alone or in combination with recycle material.

Portions of the second end 26 of the drum 22 extend into a stationary collar 42 and freely rotate therein. A discharge structure 44 is provided at the lower end of the collar 42 and a duct 46, for a purpose described in greater detail below, extends from the collar 42 at the upper end of the drum 22.

A burner assembly 48, for producing a flame 49, is secured to the collar 42 and extends for a distance into the smaller diameter portion 30. The burner assembly 48 is provided with a combustion air tube 50, having a burner head 52, and a fuel line 54 extending into the tube 50. The fuel line 54 extends to the burner head 54. The burner head 52 is positioned within the drum 22 between the second end 26 and the material entry collar 36. A secondary burner assembly 56 extends into the duct 46 for providing additional heating as required.

A mineral filler line 58 and a liquid asphalt line 60 extend for a distance into the drum 22 from the second end 26. Both of the lines 58 and 60 terminate within the drum 22 between the second end 26 and the burner head 54.

An annulus 61 is defined by a combustion housing 62 and the interior surface of the drum 22 surrounding the combustion housing 62. The interior of the combustion housing forms a combustion chamber 63. The combustion housing 62, having a first end 64 and a second end 66, is secured within the smaller diameter portion 30 of the drum 22 such that the first end 64 is substantially adjacent the material entry collar 36, and the second end 66 overlies a portion of the burner assembly 48 adjacent the burner head 54.

Figure 2:
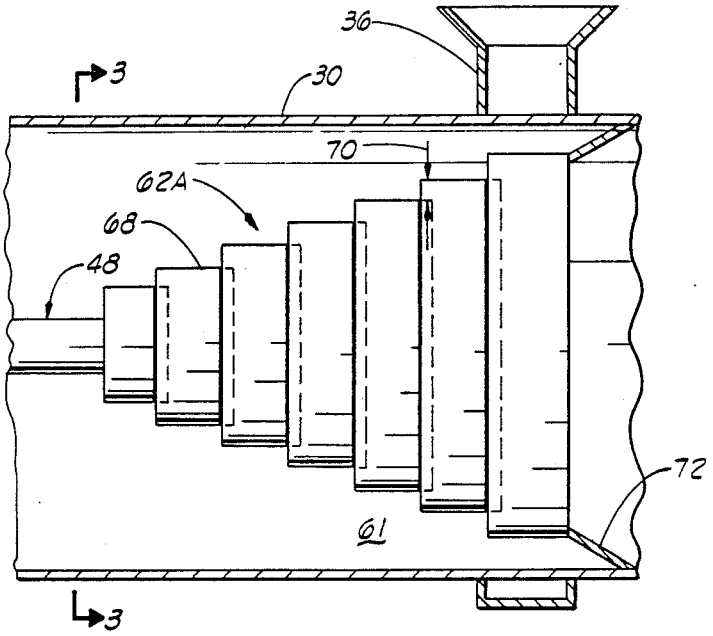
FIG. 2 is a fragmented vertical cross-section of a portion of the drum mixer illustrating a modified combustionn housing.
Figure 3:
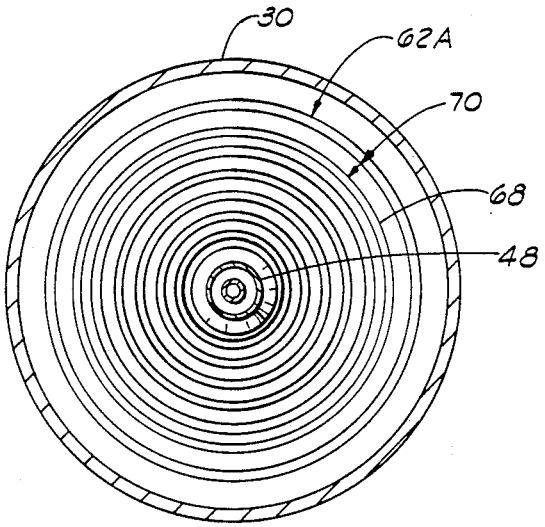
FIG. 3 is a cross-sectional view along lines 3—3 of FIG. 2.

As shown in FIG. 1, the combustion housing 62 is constructed of a plurality of telescoping rings 68, each having a unique diameter. A modified combustion housing 62A, shown in FIGS. 2 and 3, is similar to the combustion housing 62 except that combustion housing 62A includes a greater number of combustion rings 68 for a purpose discussed below. As shown in FIGS. 1–3, (certain structures, described in greater detail below, have been removed from FIGS. 2 and 3 for clarity of illustration) the rings 68 are concentricly positioned in order of largest to smallest diameter wherein the largest diameter ring 68 is adjacent the material entry collar 36 and the smallest diameter ring 68 overlies the burner head 45. he rings 68 are secured in end-to-end fashion such that the ends of adjacent rings 68 overlap. In this way, the overlapping portions of adjacent rings 68 define the openings 70.

The opening 70 nearest the maerial entry collar 36 is generally larger that the other openings 70 and is of sufficient size such that a majority of the first volume of material flows freely into the annulus 61. It will be understood that portions of the first volume of material not entering the annulus 61 through the opening 70 nearest he material entry collar 36 enter the annulus through other openings 70 rearward thereof. The openings 70 allow a portion of the radiant heat produced in the combustion chamber 63 to enter the annulus 61 while the overlapping configuration of the rings 68 prevents materials within the annulus 61 from entering the combustion chamber 63.

A flange 72 extends outwardly from the first end 64 of the combustion housin 62 and toards the first end 28 of the drum 22. The extending end of the flange 72 is secured, such as by welding, to the drum 22. The flange 72 functions to assist the flow of the firs volume of material into the first end 64 of the combustion housing 63 and into the annulus 61. he flange 72 also functions to contain the second volume of material enering the drum 22 within the annulus 61.

Referring now to FIG. 1, the interior of the drum 22 is divided into generally a drying zone 74, a drying-/mixing zone 76 and a mixing zone 78. The drying zone 74 is divided into generally two sub-zones 80 and 82. The sub-zone 80 may be provided with veiling material flights 84 and the sub-zone 82 may be provided with non-veiling material flights 86.

The material flights 84 are preferably the variable veiling density flights designated by reference numeral 82 in U.S. Application Ser. No. 07/375,362, titled, "Method And Apparatus For Producing Hot Mix Asphalt", filed July 3, 1989, by Stuart W. Murray and assigned to CMI Corporation, Oklahoma City, Okla., the disclosure of which is herein incorporated by reference. The material flights 86 are preferably the W-flights designated by reference numerals 78 and 78A in the above incorporated application.

The dying/mixing zone 76 is provided with the veiling material flights 84 and mixing zone 78 is provided with material flights 88. The material flights 88 are preferably the non-veiling flights designated by reference numeral 105 in the above incorporated application.

A zone 90, adjacent the material entry collar 36 is provided with a plurality of spiral flights 92. The spiral flights 92 function in the usual manner of spiral flights to convey material from the collar 36 into the drum 22.

Figure 5:
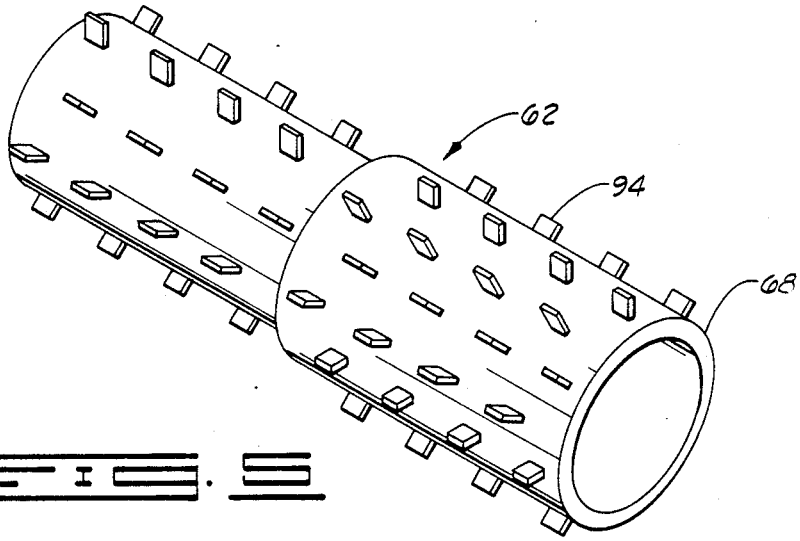
FIG. 5 is a perspective view of a portion of a combustion housing illustrating a first type of extending structure.
Figure 6:
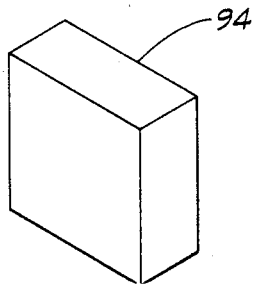
FIG. 6 is an enlarged perspective view of the extending structure illustrated in FIG. 5.

As shown schematically in FIGS. 1 and 4 and in greater detail in FIGS. 5 and 6, a plurality of extending structures 94, generally rectangular-shaped, are secured to portions of the combustion housing 62. With the exception of the ring 68 adjacent the material entry collar 36, each ring 68 is provided with rows of extending structures 94 arranged in circumferentially spaced relation around the outer periphery thereof. In this way, the extending structures 94 extend from the combustion housing 62 and into the annulus 61. It will be understood that the circumferential spacing between the extending structures 94 in particular rows is substantially uniform and that adjacent rows of extending structures 94 are oriented such that the respective extending structures 94 therein are laterally offset.

Figure 7:
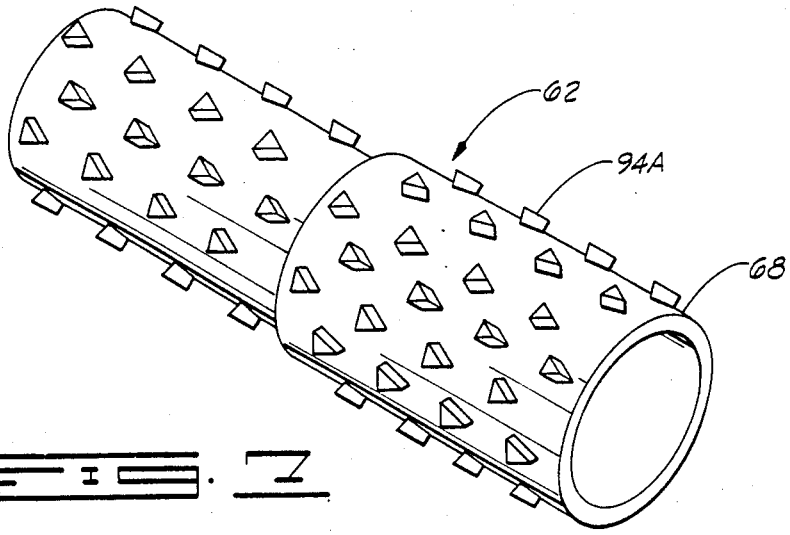
FIG. 7 is a perspective view of a portion of a combustion housing illustrating a second type of extending structure.
Figure 8:
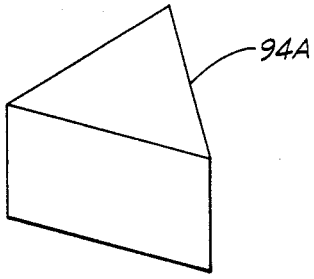
FIG. 8 is an enlarged perspective view of the extending structure illustrated in FIG. 7.

A modified extending structure 94A is shown in FIGS. 7 and 8. Each extending structure 94A is triangular-shaped in cross-section and is spaced along the outer periphery of the combustion housing 62 similarly to the extending structures 94.

Figure 9:
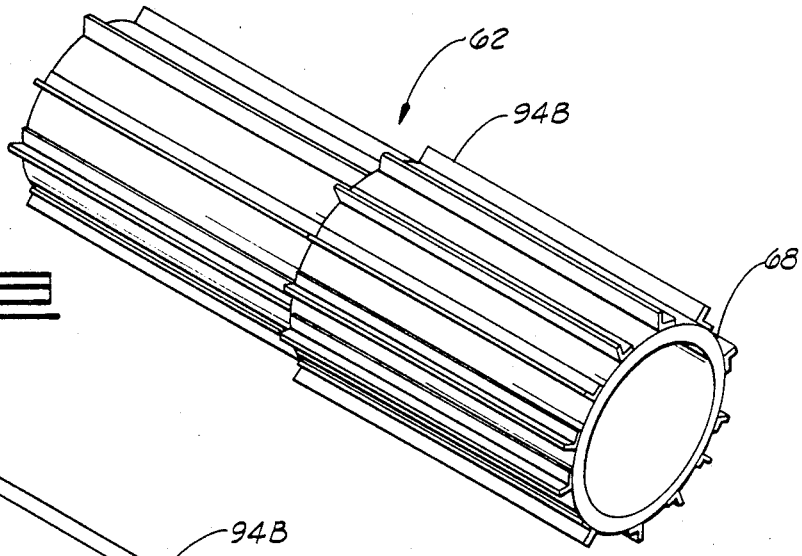
FIG. 9 is a perspective view of a portion of a combustion housing illustrating a third type of extending structure.
Figure 10:
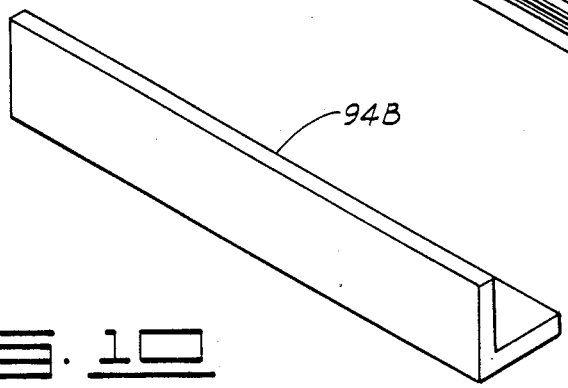
FIG. 10 is an enlarged perspective view of the extending structure illustrated in FIG. 9.

A modified extending structure 94B, shown in FIGS. 9 and 10, is L-shaped in cross-section and extends laterally over substantially the length of the respective ring 68. Extending structures 94B are arranged in circumferentially spaced relation around the outer periphery of the respective ring 68. It will be understood, as mentioned above, that the circumferential spacing is substantially uniformand that but for the ring 68 adjacent the material collar 36, each ring 68 of the combustion housing 62 is provided with the extending structures 94B.

In accordance with the present invention, the method for continuously producing an asphaltic composition preferably is carried out by rotating nthe drum 22 as the first volume of material is introduced into the first end 24 thereof. As the first volume of material flows toards the second end 26, it is heated within the drying zone 74 by a first stream of hot gases produced by the flame 49. The first stream of hot gases generally flows from the burner head 54 to the first end 24 of the drum 22 in countercurrent relation to the flow of the first volume of material.

As described above, the first volume of material enters the annulus 61 and is combined with the second volume of material entering the drum 22 through the material collar 36. The second volume of material flows generally form the material entry collar 36 to the second end of the drum 22.

Within the drying/mixing zone 76, the first and second volumes are mixed and cascaded over the combustion housing 62 by the veiling flights 84. As mentioned previously, the mixing first and second volumes of materials are prevented from entering the combustion chamber 63 by the combustion housing 62 while a portion of the radiant heat produced in the combustion chamber 63 enters the annulus 61 through the openings 70 and heats said materials. Heat is also transferred to the cooler second volume of material by conduction from the hot first volume of material and by conduction from the hot surface of the combustion housing 62, and the extending structures 94, 94 A, or 94 B.

As the mixing materials enter the mixing zone 78, liquid asphalt and mineral filler may be added through the respective lines, 60 and 58, as required. The secondary burner assembly 56 may be utilized to provide a second stream of hot gases for heating the materials in the mixing zone 78. The second stream of hot gases flows from thes econd end 26 of the drum 22 to the first end 24 thereof in countercurrent relation to the flow of the mixing materials. The asphaltic composition produced is discharged form the drum 22 through the discharge structure 44.

During operation of the drum mixer 20, an area of reduced pressure is created in the mixing/drying zone 76 and the mixing zone 78 by the flame 49. In this way, any combustible materials created or released in either zone, 76 and/or 78, circulate through the openings 70 within the combustion housing 62 and into the combustion chamber 63 for burning.

Depending upon certain factors, such as, for example, the composition of the first and second volumes of material and the capacity of the particular drum mixer, the combustion housing may be constructed of a varying number of rings 68 as shown in FIGS. 1 and 2. By selectively varying the number of rings 68 within the combustion housing, the heat transfer to the materials within the annulus 61 may be selectively controlled.

Changes may be made in the construction, operation, and arrangement of the various parts, elements, steps, and procedures described herein without departing from the spirit and scope of the invention as defined in the following claims.

What is claimed is:

1. An apparatus for continuously producing an asphaltic composition comprising:

a rotatable drum having a first end and a second end;

means for generating a flame at an intermediate position within the rotatable drum for producing a first stream of hot gases;

a combustion housing secured within the drum such that an annulus is formed between the drum and the combustion housing, wherein the combustion housing substantially surrounds the flame;

means for introducing a first volume of material into the rotatable drum at the first end thereof, wherein the first volume of material is heated by the first stream hot gases, and wherein the first volume of material flows through the annulus towards the second end of the rotatable drum;

means for introducing a second volume of material into the annulus;

means for mixing the second volume of material with the first volume of material in the annulus, wherein the mixing materials travel towards the second end of the rotatable drum; and means for discharging the mixture of the first and second volumes of material at the second end of the drum.

2. The apparatus of claim 1 further comprising means for introducing liquid asphalt into the mixing first and second volumes of materials to produce the asphaltic composition.

3. The apparatus of claim 1 wherein the first volume of material comprises virgin aggregate material and the second volume of material comprises recycle material.

4. The apparatus of claim 1 wherein the first volume of material comprises virgin aggregate material and the second volume of material comprises virgin aggregate material.

5. The apparatus of claim 1 wherein the first volume of material includes virgin aggregate and recycle material.

6. The apparatus of claim 1 wherein the second volume of material includes virgin aggregate and recycle material.

7. The apparatus of claim 1 further including means for radiating heat through the combustion housing for heating the mixing first and second volumes of materials.

8. The apparatus of claim 7 wherein the emans for radiating heat through the combustion housing is characterized by the combustion housing having a plurality of openings therein.

9. The appartus of claim 8 wherein the combustion housing is further characterized by a plurality of varying diameter rings, and wherein the rings are secured substantially in end-to-end fashion, and wherein each opening is defined by overlapping portions of adjacent rings.

10. The apparatus of claim 9 wherein the rings are positioned in a gradual descending telescoping fashion, and wherein the largest diameter ring is closest to the first end of the rotatable drum and the smallest diameter ring is between the largest diameter ring and the second end of the rotatable drum.

11. The apparatus of claim 1 further including means for circulating combustible gases produced within the drum between the combustion housing and the second end thereof into the flame for burning.

12. The apparatus of claim 11 wherein the means for circulating combustible gases produced between the combustion housing and the second end of the drum includes a combustion housing having a plurality of openings therein.

13. The apparatus of claim 12 wherein the combustion housing is further characterized by a plurality of varying diameter rings, and wherein the rings are secured substantially in end-to-end fashion, and wherein each opening is defined by overlapping portions of adjacent rings.

14. The apparatus of claim 13 wherein the rings are positioned in a gradual descending telescoping fashion, and wherein the largest diameter ring is closest to the first end of the rotatable drum and the smalleslt diameter ring is between the largest diameter ring and the second end of the rotatable drum.

15. The apparatus of claim 1 wherein the first stream of hot gases is directed towards the first end of the rotatable drum.

16. The apparatus of claim 1 characterized further to include means for creating a second stream of hot gases, wherein the second stream of hot gases is introduced into the drum at the second end thereof an flows toward the first end of the drum and wherein the second stream of hot gases heats the mixing first and second volumes of material.

17. The apparatus of claim 1 including a plurality of extending structures secured to the combustion housing and extending into the annulus.

18. The apparatus of claim 17 wherein the extending structures are characterized as being rectangular-shaped.

19. The apparatus of claim 17 wherein the extending structures are characterized as being triangular-shaped in cross-section.

20. The apparatus of claim 17 wherein the extendng structures are characterized as being L-shaped in cross section.

21. In a method for continuously producingan asphaltic composition comprising the following steps:

creating a flame in a combustion chamber within an inclined rotating drum between a first end and a second end of the drum for generating a first stream of hot gases therein and for generating radiant heat within the combustion chamber;

creating an annulus within the drum substantially overlying the combustion chamber such that a portion of the radiant heat generated within the combustion chamber enters the annulus;

introducing a first volume of material into the first end of the drum, wherein the first volume of material flows through the annulus towards the second end of the drum;

heating the first volume of material with the first stream of hot gases;

introducing a second volume of material into the annulus;

mixing the first and second volumes of material within the annulus; and discharging the mixture of the first and second volumes of material at the secondn end of the drum.

22. The method of claim 21 including the step of generating a second stream of hot gases to flow from the second end of the drum to the first end of the drum for heating the first and second volumes of materials.

23. The method of claim 21 wherein the annulus is created by placing a combustion housing within the drum, and wherein the combustion housing substantially overlies the flame.

24. The method of claim 23 wherein the combustion housing is constructed of a plurality of varying diameter rings secured together in a substantially end-to-end fashion.

25. The method of claim 24 wherein the rings are positioned in a gradual descending telescoping fashion, and wherein the largest diameter ring is closest to the first end of the drum and the smallest diameter ring is between the largest diameter ring and the second end of the rotatable drum.

26. The method of claim 24 wherein each ring is concentricly positioned within the drum, and wherein a portion of each ring overlies a portion of an adjacent ring such that an annular opening is formed between adjacent rings.

27. The method of claim 26 wherein the radiant heat enters the annulus through the annular openings.

28. The method of claim 21 including the step of mixing liquid asphalt with the mixing first and second volumes of materials to produce the asphaltic composition.

29. The method of claim 21 wherein the first volume of material comprises virgin aggregate material and the second volume of material comprises recycle material.

30. The method of claim 21 wherein the first volume of material comprises virgin aggregate material and the second volume of material comprises virgin aggregate.

31. The method of claim 21 wherein the first volume of material includes virgin aggregate material and recycle material.

32. The method of claim 21 wherein the second volume of material includes virgin aggregate material and recycle material.

33. The method of claim 21 including the step of directing combustible products produced by the mixing materials into the combustion chamber to be burned.

34. The method of claim 21 wherein the first volume of material is introduced into the drum at the first end thereof.

* * * * *

UNITED STATES PATENT AND TRADEMARK OFFICE
CERTIFICATE OF CORRECTION

PATENT NO. : 4,919,538

DATED : April 24, 1990

INVENTOR(S) : George W. Swisher, Jr.

It is certified that error appears in the above-identified patent and that said Letters Patent is hereby corrected as shown below:

Col. 1, line 17, "drrum" should be --drum--.

Col. 1, line 22, "got" should be --hot--.

Col. 1, line 29, "innput" should be --input--.

Col. 1, line 55, "combustionn" should be --combustion--.

Col. 1, line 64, "materialsl" should be --materials--.

Col. 4, line 4, "he" should be --The--.

Col. 4, line 14, "he material" should be --the material--.

Col. 4, line 22, "toards" should be --towards--.

Col. 4, line 25, "firs" should be --first--.

Col. 4, line 27, "63" should be --62--.

Col. 4, line 27, "he" should be --The--.

Col. 5, line 15, "uniformand" should be --uniform and--.

Col. 5, line 21, "nthe" should be --the--.

Col. 5, line 23, "toards" should be --towards--.

Col. 5, line 34, "form" should be --from--.

Col. 5, line 55, "thes econd" should be --the second--.

Col. 5, line 58, "form" should be --from--.

UNITED STATES PATENT AND TRADEMARK OFFICE

CERTIFICATE OF CORRECTION

PATENT NO. : 4,919,538

DATED : April 24, 1990

INVENTOR(S) : George W. Swisher, Jr.

It is certified that error appears in the above-identified patent and that said Letters Patent is hereby corrected as shown below:

Col. 6, line 59, "emans" should be --means--.

Col. 7, line 34, "an" should be --and--.

Col. 7, line 50, "producingan" should be --producing an--.

Col. 8, line 12, "secondn" should be --second--.

Signed and Sealed this

Ninth Day of July, 1991

*Attest:*

HARRY F. MANBECK, JR.

*Attesting Officer*

*Commissioner of Patents and Trademarks*